United States Patent [19]

Preston et al.

[11] 4,089,675

[45] May 16, 1978

[54] COMBINATION BENEFICIATION ILMENITE DIGESTION LIQUOR REDUCTION PROCESS

[75] Inventors: Peter Joseph Preston; George Leathwhite Roberts, Jr.; Dennis Arthur Filimore; Gerard Martin Sheehan, all of Savannah, Ga.

[73] Assignee: American Cyanamid Company, Stamford, Conn.

[21] Appl. No.: 729,913

[22] Filed: Oct. 5, 1976

[51] Int. Cl.[2] ..... C22B 1/00

[52] U.S. Cl. ..... 75/1 T; 75/104; 423/82; 423/86

[58] Field of Search ..... 75/1, 1 T, 115, 101 R, 75/104; 423/82, 86, 146, 150

[56] References Cited

U.S. PATENT DOCUMENTS

| | | | |
|---|---|---|---|
| 1,542,350 | 6/1925 | Whittemore | 75/1 T |
| 3,094,386 | 6/1963 | Wigginton | 423/86 |
| 3,112,178 | 11/1963 | Judd | 423/86 |
| 3,169,046 | 2/1965 | Nespital | 423/146 |
| 3,252,787 | 5/1966 | Shiah | 75/101 R |
| 3,403,977 | 10/1968 | Heywood et al. | 423/616 |
| 3,446,590 | 5/1969 | Michal et al. | 75/101 R |
| 3,627,508 | 12/1971 | Hughes et al. | 423/86 |
| 3,660,029 | 5/1972 | Naguib | 75/1 T |
| 4,014,977 | 3/1977 | Piccolo et al. | 423/616 |

*Primary Examiner*—L. Dewayne Rutledge
*Assistant Examiner*—Michael L. Lewis
*Attorney, Agent, or Firm*—Frank M. Van Riet

[57] ABSTRACT

A process is disclosed which removes iron from ilmenite ore thereby rendering it suitable for use in the chlorination process for forming $TiO_2$ from titanium ores. One advantage of the disclosed process is that the iron is removed from the ilmenite by a method which performs a reduction step in the sulfuric acid process for producing $TiO_2$ from titanium ore.

2 Claims, No Drawings

COMBINATION BENEFICIATION ILMENITE DIGESTION LIQUOR REDUCTION PROCESS

This invention relates to a process for beneficiating ilmenite ores by removing iron therefrom in order to render them suitable for use in the chlorination process for the production of $TiO_2$. More specifically, it relates to a process for beneficiating ilmenite ore which also accomplishes a necessary step in the sulfuric acid process for preparing titanium dioxide from ilmenite.

There are two processes for the manufacture of titanium dioxide pigment from titanium containing ores. The first is the chlorination process in which the titanium ore is reacted with a carbon source and chlorine to form $TiCl_4$ which is then oxidized to form the desired $TiO_2$ and recyclable chlorine.

The second process is the sulfuric acid process in which the titanium containing ore is digested with sulfuric acid to form a cake containing sulfate salts, which is dissolved to form the digestion liquor containing the sulfate salts of the iron, titanium and other metals contained in the ore. After further processing to remove impurities and achieve the desired acid content, the digestion liquor is hydrolyzed to form hydrous titanium dioxide which upon calcination converts either anhydrous anatase or rutile.

For the chlorination process, the natural rutile type is preferred since it is an ore which consists mainly of titanium dioxide. Such ores, unfortunately, are becoming scarce and hence are increasingly more expensive. Therefore, users of the chlorination process have been forced to turn to the cheaper and more abundant ilmenite ores. Ilmenites, however, contain high percentages of iron, which preferably must be removed prior to chlorination.

The sulfuric acid process can use ilmenite ore provided that the soluble iron values are in the $Fe^{II}$ state. This is achieved by a reduction step where scrap iron is used to convert all $Fe^{III}$ to $Fe^{II}$. After all the iron in the digestion liquor is reduced to the ferrous state, a specific amount of the ferrous sulfate precipitates as copperas ($FeSO_4.7H_2O$) upon cooling. This precipitation of $FeSO_4.7H_2O$ is controlled to yield a weight ratio of 1 for $FeSO_4$ and $TiO_2$ in the liquor.

If the iron in the digestion liquor is not fully reduced to the ferrous state the ferric sulfate will be carried on through the process and cause iron contamination of the final product. Therefore, the iron and some $TiO_2$ in the digestion liquor is generally reduced with scrap iron.

In the chlorination process, it is preferred that the iron be removed prior to the chlorination, since iron forms volatile chlorides which are difficult to separate from $TiCl_4$. There are several techniques for beneficiating ilmenite ore to remove the iron contents prior to chlorination. Some of these processes involve leaching the iron from the ilmenite with dilute acid such as hydrochloric acid. This process suffers from the disadvantage that it uses large volumes of acids and produces equally large volumes of iron salt solutions, which present disposal problems. Other more preferred processes reduce the ilmenite with reducing agents such as carbon, carbon monoxide or hydrogen to produce a reduced ilimenite comprising a mixture of $TiO_2$ and metallic iron. In this case, it is desirable to first oxidize the ilmenite to assure that all the iron is in the ferric form and thus more amenable to reduction. However it may be formed, the reduced ilmenite may be treated in several ways to remove the iron. In some of these processes the $TiO_2$ and the metallic iron are separated by mechanical means based on differences in density or differences in the magnetic properties of $TiO_2$ and metallic iron. These processes are not particularly successful, however.

Other processes selectively leach the metallic iron from the reduced ilmenite using reagents such as dilute acids or $NH_4Cl$ solution and air. One such process disclosed in U.S. Pat. No. 3,252,787 teaches the use of ferric salt, such as the chloride or sulfate for leaching the metallic iron from the reduced ilmenite. In this process, the metallic iron from the reduced ilmenite is oxidized to ferrous iron while the ferric iron from the leaching solution is reduced to the ferrous state. Thus, the iron from the reduced ilmenite is dissolved and the by-product is a solution of a ferrous salt. The resultant beneficiate contains about 91% $TiO_2$ and 1.2% iron. The ferrous salt solution may be treated with oxygen to form ferric oxide and the original ferric salt, which may then be recycled. On each recycling, approximately 5% of the ferric salt is rejected and replaced with fresh ferric salt in order to prevent the build-up of impurities. This replacement of the ferric salt is relatively costly.

Accordingly, it is an object of the present invention to provide an economical process for beneficiating ilmenite ore in order to render it useful in the chlorination process while at the same time avoiding the use of large quantities of an expensive reductant such as scrap iron for reduction of oxidized ilmenite type digestion liquors.

According to the present invention, we have discovered that reduced ilmenite, that is ilmenite which has been subjected to a reducing treatment and thus consists essentially of titanium dioxide, metallic iron, and possibly some unreduced iron oxide, may be reacted with an ilmenite digestion liquor formed by the digestion of ilmenite ore with sulfuric acid and dissolution of the sulfate salts. The exact nature of the process used to produce the reduced ilmenite is not critical of this invention. Any method may be used as long as the reduced product has greater than 90% of its titanium values of the unreduced $TiO_2$ form and about 80% of its iron in the metallic form.

In this process, the ferric salts in the digestion liquor react with the metallic iron in the reduced ilmenites, thereby dissolving the metallic iron in the reduced ilmenite by oxidizing it to the ferrous state and reducing the ferric iron in the digestion liquor to the ferrous state. In addition, since the digestion liquor contains a moderate concentration of sulfuric acid, it will serve to dissolve most of the iron that has not been reduced to the metallic form, while at the same time dissolving only a small quantity of titanium dioxide. The titanium dioxide which dissolves in the digestion liquor is, of course, not lost, for it is recovered as part of the product produced by the sulfuric acid process. This is a distinct advantage over other beneficiation processes. The iron in the ilmenite ore which has not been reduced to the metallic state is generally in the form of the ferrous oxidation state. If, however, some ferric iron remains in the reduced ilmenite, it may dissolve in the digestion liquor, and be reduced to the ferrous state along with the ferric iron originally present in the digestion liquor. By these means, substantially all the iron from the reduced ilmenite will be dissolved and the ferric iron in the digestion liquor converted to the ferrous form.

In practice it is often desirable to use a slight excess of the reduced ilmenite over the amount required to fully reduce the ferric iron in digestion liquor to the ferrous state. This excess iron will reduce a small amount of titanium in the digestion liquor from $Ti^{+4}$ to $Ti^{+3}$ and thereby assure than all ferrous iron which is in digestion liquor will be in the ferrous state, for reduced titanium is more readily oxidized than ferrous iron.

The reaction of the ferric iron with the metallic iron may be conducted at any temperature from about 20° C. to the boiling point of the digestion liquor, although is proceeds faster at higher temperatures. The reduction of the titanium dioxide, however, requires a temperature of about 55° C. or greater, to proceed at a reasonable rate, and may also be conducted at any temperature up to the boiling point of the digestion liquor. However, higher temperatures (above 60° C.) lead to premature hydrolysis and precipitation of hydrous titanium oxide. The reaction time required to achieve the desired reduction depends not only on the temperature at which the reaction is conducted, but also upon the physical state of the reduced ilmenite. The choice of reaction temperature depends upon many factors. Warming the reaction mixture decreases the reaction time but increases the hydrolysis tendency. On the other hand, conducting the reaction at a lower temperature increases the reaction time, and therefore cuts down on the amount of material the given reactors are able to process. In addition, as noted above, some ores may react faster than others. Thus, it is not possible to set forth a set of ideal reaction conditions applicable to every situation. However, it is readily possible to analyse the digestion liquor as the process is proceeding and determine, in any given case, whether or not all the soluble iron is in the $Fe^{II}$ state.

This process provides for the economic utilization of troublesome impurities in ilmenite ore, which would otherwise have been waste products. The iron from the ilmenite to be beneficiated for use in the chlorination process is used to reduce ferric iron present in the digestion liquor in the sulfuric acid process and for reagents to leach iron from ilmenite to be used in the chlorination process. Instead of using expensive reagents and creating large quantities of waste materials in beneficiating ilmenite and reducing the iron in the digestion liquor, this process uses only ilmenite and an inexpensive reducing agent, suitable for reducing the iron oxide in the ilmenite, to achieve the desired results, and at the same time produces a useable by-product — solid copperas.

Millions of pounds of $TiO_2$ are produced every year and even a very small reduction in per unit cost represents a very attractive saving. Thus, while the replacing of cheap materials such as scrap iron and ferric salts with even cheaper materials such as ilmenite and coal may not seem to be a great savings, the benefits become sizeable when several million pounds of material are processed.

The following examples are provided for illustration and may include particular features of the invention. However, the examples should not be construed as limiting the invention, many variations of which are possible without departing from the spirit or scope thereof.

EXAMPLE 1

Reduction of Ilmenite with Coal

1 Kilogram of Florida ilmenite containing 64.5% $TiO_2$ is mixed with 600 grams of sub-bituminious coal and heated in the absence of oxygen, to 1100° C. for 2 hours. The reaction mixture is cooled and the product contains 68% $TiO_2$, 22% metallic iron, 3% FeO and mineral residue derived from the coal.

EXAMPLE 2

Reaction of Reduced Ilmenite with Ilmenite Digestion Liquor 100 grams of reduced ilmenite prepared according to the procedure of Example 1 are mixed with 1 liter of ilmenite digestion liquor. The initial temperature of the mixture is 23° C. and after 55 minutes the mixture temperature is 60° C. The reaction is complete in 85 minutes, the solids are filtered from the digestion liquor and washed with 20% sulfuric acid and then hot water. The composition of the ore and the liquor before and after the reaction is shown in the following tables:

| | ORE COMPOSITION | |
|---|---|---|
| | Before Reaction | After Reaction |
| Ore Weight | 100 grams | 54.3 grams |
| $TiO_2$ | 64.7% | 93.2% |
| Fe Metal | 24.7% | — |
| FeO | 8.4% | 2.8% |

| | LIQUOR COMPOSITION | |
|---|---|---|
| | Before Reaction | After Reaction |
| Volume | 1 liter | 1 liter |
| $Ti^{+4}$ (as $TiO_2$) | 152.9 g/liter | 167.0 g/liter |
| $Ti^{+3}$ (as $TiO_2$) | — | 2.9 g/liter |
| $Fe^{+3}$ | 47.4 g/liter | — |
| $Fe^{+2}$ | 12.9 g/liter | 90.4 g/liter |
| Fe total | 60.3 | 90.4 g/liter |

The ore which remains after the reaction contains 93.2% $TiO_2$ and 2.8% Fe as FeO. The final filtrate contains 167.0 g/l $TiO_2$, 90.4 g/l Fe as $Fe_2O_3$ and 2.9 g/l $TiO_2$(reduced).

EXAMPLE 3

Reaction of Reduced Ilmenite with Ilmenite Digestion Liquor 330 grams of reduced ilmenite prepared according to the procedure of Example 1 are mixed with 3.5 liters of ilmenite digestion liquor and reacted at 60° C. for 2 hours and 10 minutes. The solids are filtered and washed with 20% sulfuric acid and then hot water. The composition of the ore and digestion liquor before and after the reaction is shown in the following tables:

| | ORE COMPOSITION | |
|---|---|---|
| | Before Reaction | After Reaction |
| Ore Weight | 330 grams | 199.5 grams |
| $TiO_2$ | 68.7% | 92.6% |
| Fe Metal | 20.6% | — |
| FeO | 5.5% | 2.7% |

| | LIQUOR COMPOSITION | |
|---|---|---|
| | Before Reaction | After Reaction |
| Volume | 3.5 liters | 3.5 liters |
| $Ti^{+4}$ (as $TiO_2$) | 135.4 g/liter | 147.4 g/liter |
| $Ti^{+3}$ (as $TiO_2$) | — | 3.2 g/liter |
| $Fe^{+3}$ | 36.7 g/liter | — |
| $Fe^{+2}$ | 9.5 g/liter | 68.4 g/liter |
| Fe Total | 46.2 g/liter | 68.4 g/liter |

The core which remains after the reaction contains 92.6% $TiO_2$ and 2.7% Fe, As FeO, which is equivalent to the normal rutile chlorination feed and the resulting digestion liquor yields a good quality $TiO_2$ pigment.

EXAMPLE 4

297.5 grams of reduced ilmenite prepared according to the procedure of Example 1 are mixed with 3.5 liters of ilmenite digestion liquor at 45° C. After the exothermic reaction reached its maximum temperature, the mixture was heated to maintain that maximum. The progress of the reduction/upgrading reaction was followed for three hours and the results were as recorded in the following table.

| Time (Mins.) | Temp. ° C | % $TiO_2$ in Leachate | g/l Reduced $TiO_2$ in Liquor |
|---|---|---|---|
| 5 | 45 | 91.0 | 0.73 |
| 10 | 60 | 91.3 | 2.24 |
| 15 | 60 | 91.9 | 2.81 |
| 20 | 60 | 91.9 | 3.03 |
| 25 | 60 | 91.4 | 3.26 |
| 30 | 60 | 91.7 | 3.37 |
| 40 | 60 | 92.2 | 3.51 |
| 50 | 60 | 92.4 | 3.65 |
| 60 | 60 | 92.3 | 3.82 |
| 90 | 60 | 92.8 | 4.04 |
| 120 | 60 | 92.7 | — |
| 180 | 60 | 92.8 | 4.16 |

The ore which remains after the reaction contains 92.8% $TiO_2$ and 2.8% Fe as FeO.

The composition of the ore and digestion liquor before and after the reaction is shown in the following tables:

| | ORE COMPOSITION | |
|---|---|---|
| | Before Reaction | After Reaction |
| % $TiO_2$ | 66.88 | 92.8 |
| % Fe Total | 31.0 | 2.8 |

-continued

| | ORE COMPOSITION | |
|---|---|---|
| | Before Reaction | After Reaction |
| % Fe° | 26.7 | — |

| | LIQUOR COMPOSITION | |
|---|---|---|
| | Before Reaction | After Reaction |
| $Ti^{+4}$ (As $TiO_2$) | 138.0 | 148.7 |
| $Ti^{+3}$ (As $TiO_2$) | — | 4.16 |
| $Fe^{+3}$ | 42.8 | — |
| $Fe^{+2}$ | 16.7 | 90.5 |

We claim:

1. A process for producing a high $TiO_2$ content chlorination feed stock and a sulfate digestion liquor substantially free of ferric iron which comprises (1) contacting (A) an ilmenite digestion liquor produced by the digestion of ilmenite with sulfuric acid and containing ferric salts and sulfuric acid at the quantity level produced in the digestion process with (B) a quantity of reduced ilmenite containing metallic iron sufficient to reduce the ferric iron contained in said ilmenite digestion liquor to the ferrous state, at a temperture between about 20° C and the boiling point of said ilmenite digestion liquor and until the reduction of ferric iron is substantially complete, whereby substantially all the iron is removed from said reduced ilmenite and substantially all ferric iron in said digestion liquor is reduced to ferrous iron, (2) charging the so-contacted reduced ilmenite to a $TiO_2$ chlorination process and (3) charging the so-contacted sulfate digestion liquor to a $TiO_2$ sulfuric acid process.

2. A process according to claim 1 wherein said ilmenite digestion liquor is contacted with said reduced ilmenite at a temperature between about 20° and 55° C. and thereafter the mixture of said reduced ilmenite and said ilmenite digestion liquor warmed to a temperature between 55° C. and the boiling point of said ilmenite digestion liquor.

* * * * *